United States Patent [19]

Heaton, Sr.

[11] Patent Number: 5,044,078

[45] Date of Patent: Sep. 3, 1991

[54] DOUBLE WELT TRIMMER

[76] Inventor: Gordon T. Heaton, Sr., Rte. 1 Box 54, Friendsville, Tenn. 37737

[21] Appl. No.: 592,653

[22] Filed: Oct. 4, 1990

[51] Int. Cl.[5] ..... B26B 21/40

[52] U.S. Cl. ..... 30/90.8; 30/280; 30/294; 83/947

[58] Field of Search ..... 30/90.4, 90.8, 280, 30/290, 294; 83/856, 923, 947

[56] References Cited

U.S. PATENT DOCUMENTS

| | | | |
|---|---|---|---|
| 3,212,369 | 10/1965 | Wry | 30/90.8 X |
| 3,290,780 | 12/1966 | Oehlert . | |
| 3,375,579 | 4/1968 | Slonksnes | 30/90.8 |
| 3,543,400 | 10/1968 | Scott et al. . | |
| 3,611,571 | 10/1969 | Belling . | |
| 4,064,627 | 12/1977 | Zanfini . | |

FOREIGN PATENT DOCUMENTS

| | | | |
|---|---|---|---|
| 1248271 | 3/1926 | United Kingdom | 30/290 |

*Primary Examiner*—Douglas D. Watts
*Attorney, Agent, or Firm*—Pitts & Brittian

[57] ABSTRACT

A double welt trimmer (10) for trimming selvage (28) from a double welt cord (22) used in upholstery. The double welt trimmer (10) includes a housing (12) which includes a forward and rearward end (32 and 34). A double welt guide (14) is carried by the housing (12) and includes at least one through hole (44) opening on the forward and rearward ends (32 and 34) and dimensioned to closely receive and guide the double welt (22). The double welt guide (14) includes a substantially radial slot (46) to receive and guide the selvage (28). A cutting blade (16) is attached to the housing (12) at an acute angle proximate the forward end (32) with the cutting portion (52) of the blade (16) directed toward the rearward end (34). A J-type bolt (56) is provided for securing the cutting blade (16) on the housing (12) such that the cutting blade (16) may be selectively mounted and adjusted. In another embodiment, at least one set screw (74) is provided to fix the cutting blade (16) to the housing (12). A C-type clamp (86) is connected to the housing (12) for securing the double welt trimmer (10) to a supporting surface (30).

13 Claims, 3 Drawing Sheets

DOUBLE WELT TRIMMER

DESCRIPTION

1. Technical Field

This invention relates to the field of upholstery. More specifically it relates to a device for trimming selvage from double welts prior to being affixed to furniture upholstery.

2. Background Art

In the field of furniture upholstery, it is well known that welts and double welts are used to protect and stiffen corners of furniture. It is also known that a welt is manufactured by sewing a selected fabric around a cord with a selected diameter, this process leaving a selvage to be trimmed before being affixed to the furniture. Typically this selvage is removed with scissors. This process is often time-consuming, cumbersome and painful to the hand, especially when working with heavier fabrics and for long periods of time.

Other trimmers have been produced to cut particular objects such as those devices disclosed in U.S. Pat. Nos. 3,290,780 issued to D. D. Oehlert on Dec. 13, 1966; U.S. Pat. No. 3,543,400 issued to F. Scott et al on Dec. 1, 1970; U.S. Pat. No. 3,611,571 issued to W. F. Belling on Oct. 12, 1971; and U.S. Pat. No. 4,064,627 issued to V. Zanfini on Dec. 27, 1977. Of these devices, the U. S. Pat. No. 3,543,400 and U.S. Pat. No. 4,064,627 describe carpet cutters for removing selvage from carpet, the cutter being moved along the edge of the carpet. The U.S. Pat. No. 3,611,571 describes a device for stripping a severable support wire from a plastic-covered telephone cable, the device here being moved along the telephone cable to remove the support wire. When trimming the selvage from a double welt, however, it is more desirable to fix the trimming device and move the fabric along the device, thus allowing the user to use both hands to hold the double welt and the selvage as opposed to using one hand for the double welt and selvage and the other hand for the trimming device.

Therefore, it is an object of this invention to provide a means for trimming selvage from a double welt to be used in upholstery.

It is also an object of this invention to provide a means whereby the trimming device is secured to a supporting surface such that the user may have two hands free to hold and pull the welt and selvage.

Another object of this invention is to provide a means whereby the cutting blade may be selectively mounted or adjusted such that when the blade becomes dull it may be adjusted to expose a sharpened portion or replaced with a new blade.

Still another object of this invention is to provide a means whereby the double welt is secured within the device such that an even cut will be made when trimming selvage from the double welt.

DISCLOSURE OF THE INVENTION

Other objects and advantages will be accomplished by the present invention which serves to trim selvage from a double welt cord used in upholstery. The double welt trimmer of the present invention includes a housing which is fabricated from a durable material such as plastic, bondo, hard rubber, metal or the like. The housing has a forward and a rearward end. A double welt receiving means is carried by the housing and includes at least one through hole opening on the forward and rearward ends. In the preferred embodiment, the double welt receiving means is dimensioned to closely receive and guide the double welt and includes a substantially radial slot to receive and guide the selvage. A cutting blade is attached to the housing proximate the forward end with the cutting portion of the blade directed toward the rearward end. The cutting blade is located along the slotted portion of the double welt receiving means such that as the double welt is pulled through the double welt receiving means, the selvage contacts the cutting portion of the blade and is thus severed. The cutting blade of the preferred embodiment is attached at an acute angle with the double welt receiving means such that the selvage may be trimmed more easily. A blade fixing means is provided for securing the cutting blade on the housing such that the cutting blade may be selectively mounted and adjusted. In the preferred embodiment, the blade fixing means includes a blade receptacle, a J-type bolt, and a wing nut. The blade receptacle is defined by a slot dimensioned to receive the blade such that the blade is substantially within the forward end of the housing. A through hole opening on the top and bottom faces of the housing and a hole opening on the top face of the housing and extending at least as deep as the blade receptacle are both provided to receive the J-type bolt such that the shorter leg of the bolt contacts a side of the blade and the longer leg of the bolt extends beyond the bottom face of the housing, the wing nut then being tightened on the extended portion of the J-type bolt thus releasably securing the blade. In another embodiment, the blade fixing means includes at least one set screw and a hole for each set screw, the holes opening on the housing and the blade receptacle such that the set screws may be tightened to fix the cutting blade. A trimmer securing means is connected to the housing for securing the double welt trimmer to a supporting surface. In the preferred embodiment, the trimmer securing means includes a C-type clamp attached proximate the bottom face of the housing such that the trimmer may be selectively secured to a table or other similar support surface.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A double welt trimmer incorporating various features of the present invention is illustrated generally at 10 in the figures. The double Welt trimmer 10 is designed for trimming selvage 28 from a double welt cord 22 of a selected size to be used in upholstery. Moreover, it is designed such that it may be secured to a support surface 30 such that the user may have two hands free to pull the double welt cord 22 and selvage 28 through the trimmer 10.

Figure 1:
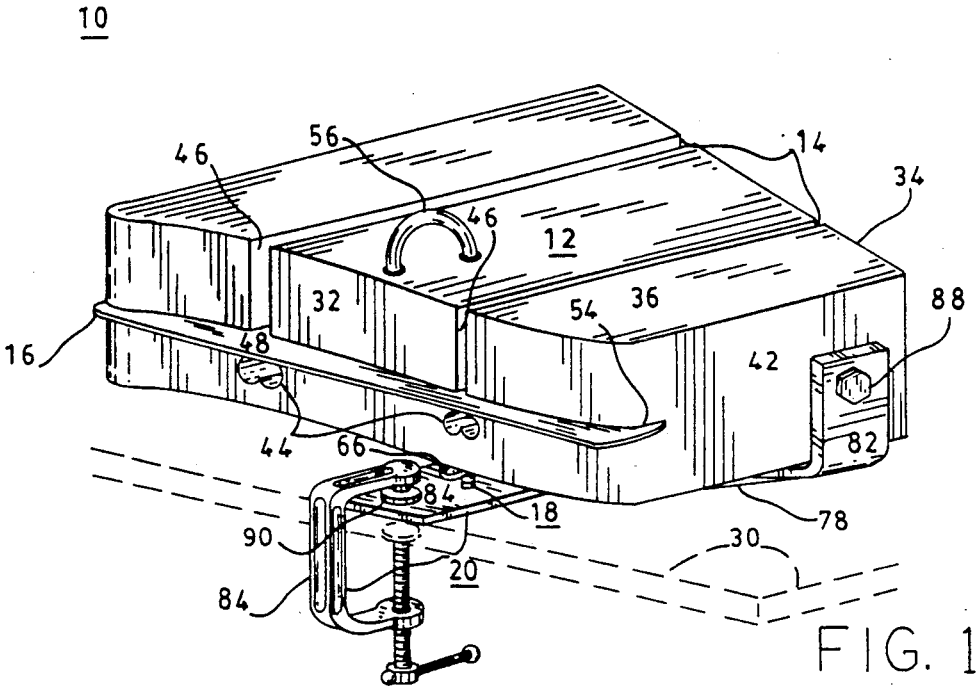
FIG. 1 is, a perspective view of the double welt trimmer constructed in accordance with the features of the present invention.
Figure 2:
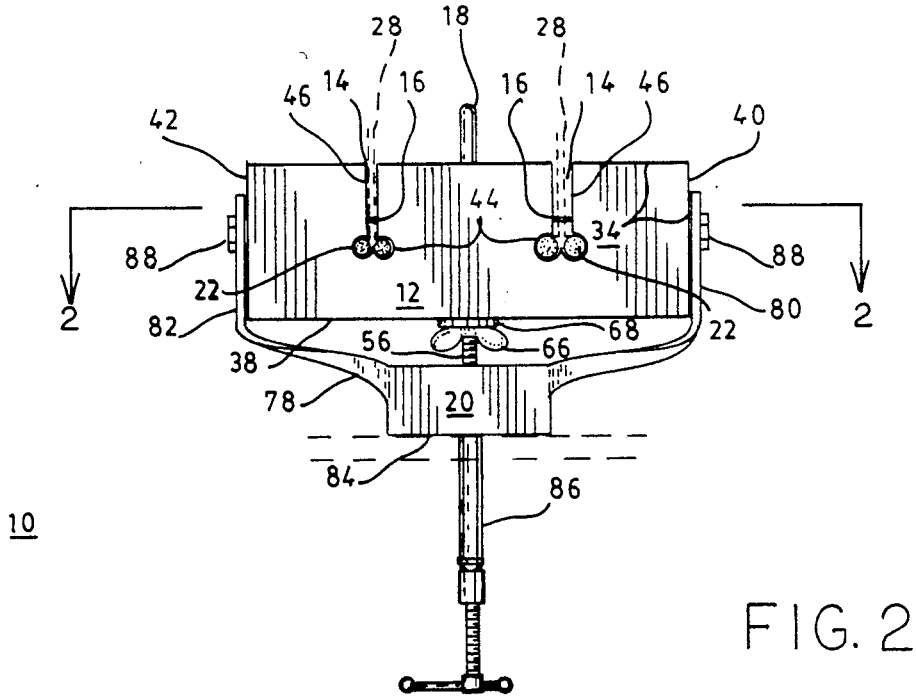
FIG. 2 is a view of the rearward end of the double welt trimmer shown in FIG. 1.
Figure 3:
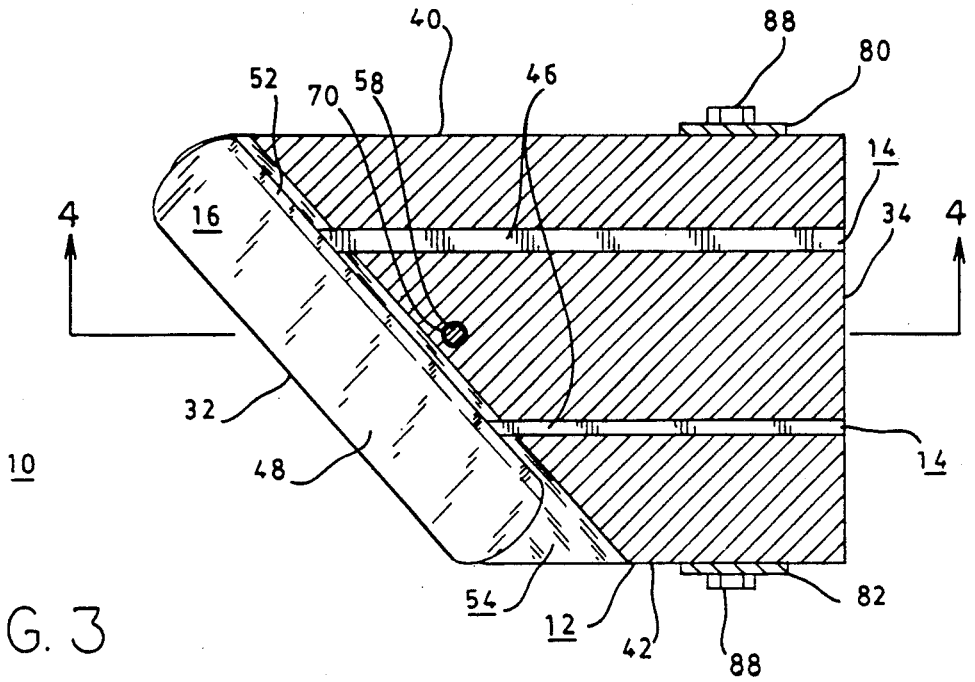
FIG. 3 is a top view, in section, of the double welt trimmer taken at 2—2 of FIG. 2.
Figure 5:
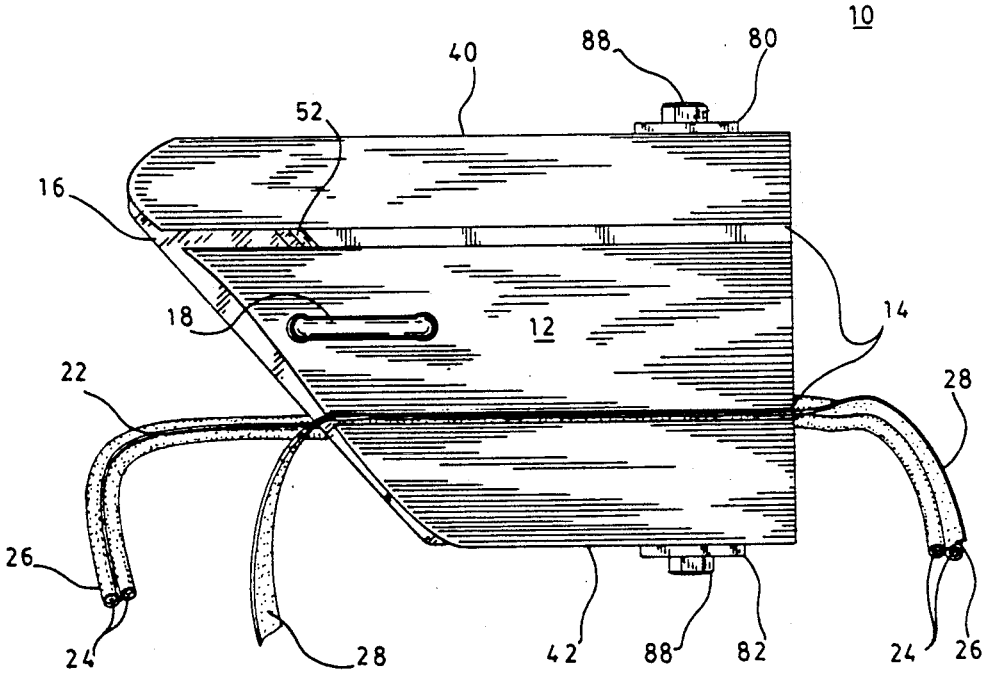
FIG. 5 illustrates a top view of the double welt trimmer shown in FIG. 1 as it is used to trim selvage from a double welt.

The double welt trimmer 10 includes a housing 12 which is fabricated from a durable material such as wood. The housing 12 substantially has a block configuration with a forward end 32, a rearward end 34, a top face 36, a bottom face 38, a left face 40 and a right face 42. As shown in FIG. 5, the forward end 32 of the preferred embodiment joins the left face 40 to form an acute angle A double welt receiving means 14 is carried by the housing 12 for securing and guiding a double welt cord 22 with a selected cord diameter and a selected material thickness. The double welt receiving means 14 includes a plurality of through holes 44 opening on the forward and rearward ends 32 and 34 of the housing 12. In the preferred embodiment shown in FIG. 2, the double welt receiving means 14 has a substantially sideways figure "8" configuration with a substantially radial slot 46 extending from the center of the sideways figure "8" and opening on the top face 36 of the housing 12. The radial slot 46 of the preferred embodiment is dimensioned to receive and guide the selvage 28 as the double welt cord 22 is being pulled through the double welt receiving means 14.

Figure 4:
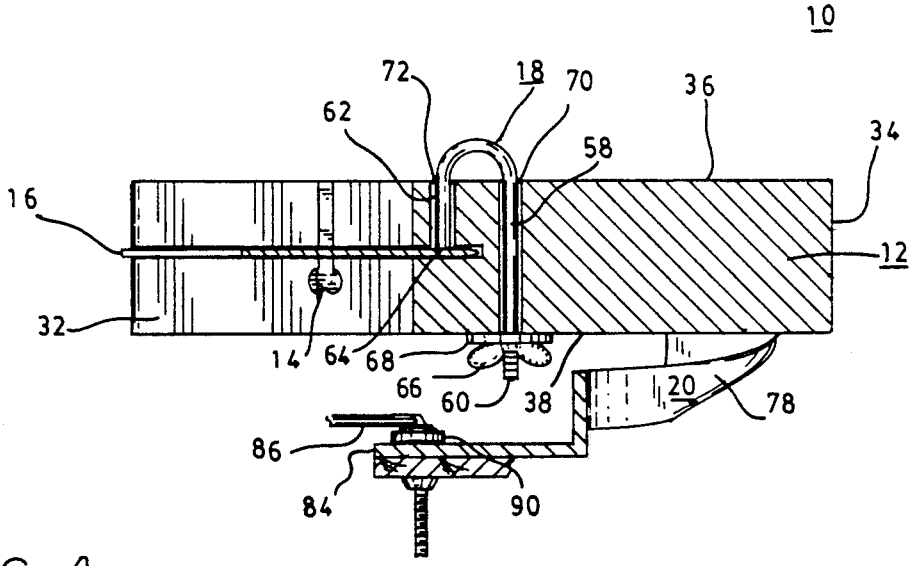
FIG. 4 illustrates a side view, in section, of the double welt trimmer taken at 4—4 of FIG. 3.
Figure 4A:
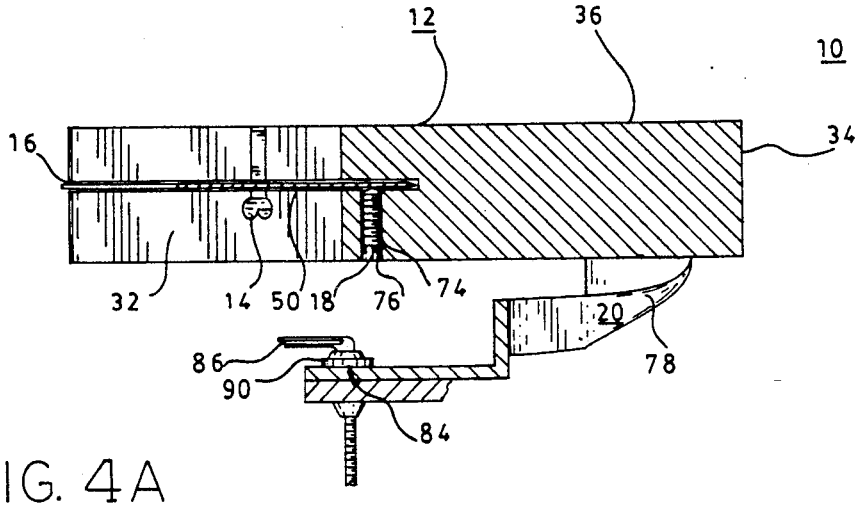
FIG. 4A illustrates a side view, in section, of the double welt trimmer taken at 4—4 of FIG. 3 showing an alternate blade fixing means.

As shown in FIGS. 4 and 4A, a cutting blade 16 for severing the selvage 28 from the double welt cord 22 is attached to the housing 12 proximate the forward end 32 of the housing 12 and bisecting the radial slot 46 of the double welt receiving means 14. The cutting blade 16 includes a first face 48, a second face 50, and a cutting edge 52. The cutting edge 52 of the blade 16 is directed toward the rearward end 34 of the housing 12 such that as the double welt cord 22 and selvage 28 are pulled through the double welt receiving means 14, the cutting edge 52 of the blade 16 contacts the selvage 28, thus severing the selvage 28 from the double welt cord 22. The cutting blade 16 of the preferred embodiment is attached at an acute angle With the double welt receiving means 14 such that the selvage 28 may be trimmed more efficiently.

A blade fixing means 18 is provided for securing the cutting blade 16 on the housing 12 such that the cutting blade 16 may be selectively mounted and adjusted. In the preferred embodiment shown in FIG. 4, the blade fixing means 18 includes a blade receptacle 54, a J-type bolt 56, and a wing nut 66. The blade receptacle 54 defines a slot dimensioned to receive the blade 16 such that the blade 16 is substantially within the forward end 32 of the housing 12. A first through hole 70 opening on the top and bottom faces 36 and 38 Of the housing 12 and a second hole 72 opening on the top face 36 of the housing 12 and extending at least as deep as the blade receptacle 54 are both provided and dimensioned to receive the J-type bolt 56. The J-type bolt 56 includes a longer leg 58 with a first end 60 and a shorter leg 62 with a second end 64. The longer leg 58 is dimensioned to be received by the first through hole 70 and the shorter leg 62 is dimensioned to be received by the second hole 72, the second end 64 contacting the first face 48 of the cutting blade 16. The first end 60 of the J-type bolt 56 is threaded to receive a wing nut 66, or the like, such that the bolt 56 and thus the blade 16 may be releasably secured. A washer 68 is provided between the housing 12 and the Wing nut 66 to protect the housing 12 and assist in keeping the wing nut 66 tight. In an alternate embodiment shown in FIG. 4A, the blade fixing means 18 includes at least one set screw 74 and a through hole 76 for each set screw 74, the through holes 76 opening on the bottom face 38 of the housing 12 and the blade receptacle 54 such that the set screws 74 contact the second face 50 of the cutting blade 16 when tightened, thus releasably securing the cutting blade 16.

A trimmer securing means 20 is connected to the housing 12 for securing the double welt trimmer 10 to a supporting surface 30. In the preferred embodiment, the trimmer securing means 20 includes a brace 78 and a C-type clamp 86. The brace 78 has a substantially Y-shaped configuration with a first arm 80, a second arm 82 and a third arm 84, the first arm 80 being attached to the housing 12 proximate the left face 40, the second arm 82 being attached to the housing 12 proximate the right face 42, and the third arm 84 being attached to the C-type clamp 86. In the preferred embodiment, the brace 78 is attached to the housing 12 with screws 88 or the like and to the C-type clamp 86 with welds 90 or the like.

From the foregoing description, it will be recognized by those skilled in the art that a double welt trimmer offering advantages over the prior art has been provided. Specifically, the double welt trimmer provides a means for trimming selvage from a double welt to be used in upholstery, the trimming process being quicker and easier than prior methods. The trimmer provides a means whereby it may be secured to a supporting surface such that the user may have two hands free to hold and pull the welt and selvage. The double welt trimmer also provides a means whereby a cutting blade may be selectively mounted or adjusted such that when the blade becomes dull it may be adjusted to expose a sharpened portion or replaced with a new blade, the cutting blade being secured within the device such that an even cut will be made when trimming selvage from the double welt.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A double welt trimmer comprising:

a housing having forward and rearward ends;

a double welt receiving means carried by said housing for retaining and guiding at least one double welt, said double welt receiving means defining at least one through hole opening on said forward and rearward ends of said housing, each of said through holes including a substantially radial slot extending from said hole and opening on said housing, said hole being dimensioned to closely receive said double welt with a selected size and said slot being dimensioned to receive said selvage; and a cutting blade for trimming said selvage from said double welt as said double welt is guided through said double welt receiving means.

2. The double welt trimmer of claim 1 wherein said double welt receiving means includes at least a first through hole with a first selected diameter and a second through hole with a second selected diameter such that double welt of at least two selected sizes may be received, said through holes opening on said rearward and forward ends.

3. The double welt trimmer of claim 1 wherein said cutting blade is connected to said housing proximate said forward end.

4. The double welt trimmer of claim 1 which further comprises a cutting blade fixing means for releasably fixing said cutting blade on said housing such that said cutting blade may be selectively mounted and adjusted.

5. The double welt trimmer of claim 1 which further comprises a securing means connected to said housing for engaging a support surface.

6. A double welt trimmer comprising:

a housing having forward and rearward ends;

a double welt receiving means carried by said housing for retaining and guiding at least one double welt, said double welt receiving means defining at least a first through hole with a first selected diameter and a second through hole with a second selected diameter, each of said through holes opening on said forward and rearward ends of said housing, each of said through holes including a substantially radial slot extending from said hole and opening on said housing, said holes being dimensioned to closely receive said double welt with a selected size and said slot being dimensioned to receive said selvage;

a cutting blade for trimming said selvage from said double welt as said double welt is guided through said double welt receiving means, said cutting blade being connected to said housing proximate said forward end;

a cutting blade fixing means for releasably fixing said cutting blade on said housing such that said cutting blade may be selectively mounted and adjusted; and a securing means connected to said housing for engaging a support surface.

7. The double welt trimmer of claim 6 wherein said cutting blade is connected to said housing at an acute angle to said double welt receiving means.

8. The double welt trimmer of claim 6 wherein said housing is fabricated of a durable material.

9. The housing of claim 8 wherein said durable material is wood.

10. The double welt trimmer of claim 6 wherein said cutting blade is a blade fabricated of a durable material.

11. The cutting blade of claim 10 wherein said durable material is steel.

12. A double welt trimmer comprising:

a housing having forward and rearward ends, said housing being fabricated from wood;

a double welt receiving means carried by said housing for retaining and guiding at least one double welt, said double welt receiving means defining at least a first through hole with a first selected diameter and a second through hole with a second selected diameter, each of said through holes opening on said forward and rearward ends of said housing, each of said through holes including a substantially radial slot extending from said hole and opening on said housing, said holes being dimensioned to closely receive said double welt with a selected size and said slot being dimensioned to receive said selvage;

a cutting blade for trimming said selvage from said double welt as said double welt is guided through said double welt receiving means, said cutting blade being fabricated from steel and being connected to said housing proximate said forward end at an acute angle to said double welt receiving means;

a cutting blade fixing means for releasably fixing said cutting blade on said housing such that said cutting blade may be selectively mounted and adjusted; and a securing means connected to said housing for engaging a support surface.

13. A method of trimming selvage from a double welt which comprises:

guiding said double welt into said through hole at said rearward end of said housing to said cutting blade;

guiding said selvage into said radial slot of said through hole to said cutting blade;

pulling said selvage away from said housing forward end at an angle substantially perpendicular to said cutting blade; and pulling said double welt away from said housing forward end at an angle substantially perpendicular to the longitudinal axis of said housing.

* * * * *